US011910913B2

(12) United States Patent
Pedoeem et al.

(10) Patent No.: US 11,910,913 B2
(45) Date of Patent: Feb. 27, 2024

(54) POP-UP DISPLAY

(71) Applicant: Crestron Electronics, Inc., Rockleigh, NJ (US)

(72) Inventors: Albert Pedoeem, West Orange, NJ (US); David Paolazzi, North Arlington, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 99 days.

(21) Appl. No.: 17/507,148

(22) Filed: Oct. 21, 2021

(65) Prior Publication Data

US 2023/0129945 A1 Apr. 27, 2023

(51) Int. Cl.
*A47B 21/007* (2006.01)

(52) U.S. Cl.
CPC .. *A47B 21/0073* (2013.01); *A47B 2021/0076* (2013.01)

(58) Field of Classification Search
CPC ..... A47B 21/0073; A47B 2021/007
USPC ..... 108/50.02
See application file for complete search history.

(56) References Cited

U.S. PATENT DOCUMENTS 1,699,710 A * 1/1929 Pearlman ..... F21V 33/00 312/312
3,188,986 A * 6/1965 La Vigne ..... A47B 23/046 108/146
3,438,687 A * 4/1969 Wikey ..... D05B 75/06 312/21
3,472,219 A * 10/1969 Roy ..... A47B 51/00 126/37 R
3,905,311 A * 9/1975 Carpentier ..... A47B 23/046 108/147

(Continued)

FOREIGN PATENT DOCUMENTS

EP 1574150 A1 9/2005
WO 2007006822 A2 1/2007
WO 2018078205 A1 5/2018

OTHER PUBLICATIONS

"Shaping the boardroom of the future 2018-2019—Arthur Holm"; pp. 1-3,11-22,43-44; https://www.arthurholm.com/wp-content/uploads/2018/07/AH_Catalog_2018-ENG.pdf.

(Continued)

*Primary Examiner* — Daniel J Troy
*Assistant Examiner* — Timothy M Ayres
(74) *Attorney, Agent, or Firm* — CRESTRON ELECTRONICS, INC.

(57) ABSTRACT

An apparatus drives and guides movement of a display assembly that includes a display unit. At least one track extends along at least one side of the display assembly and defines a path along which the display assembly is driven. A plurality of pins extend from the display assembly to the at least one track. At least one constant force spring has at one end a coiled part that is rotatably coupled to the display assembly, and an opposing end fastened to a fixed mounting location, and an uncoiled part extending between the coiled part and the opposing end. The at least one constant force spring is configured to drive the display assembly from a lowered position to a raised position while the plurality of pins travels along the at least one track and guide movement of the display assembly.

13 Claims, 8 Drawing Sheets

(56) References Cited

U.S. PATENT DOCUMENTS

| | | | | |
|---|---|---|---|---|
| 5,199,778 | A * | 4/1993 | Aoki | F25D 25/02 108/147 |
| 5,401,089 | A * | 3/1995 | Inagaki | A47B 21/0073 312/7.2 |
| 5,797,666 | A * | 8/1998 | Park | A47B 21/0073 312/223.3 |
| 7,207,278 | B2 * | 4/2007 | Latino | A47B 21/0073 108/50.01 |
| 7,517,029 | B2 * | 4/2009 | Cvek | A47B 21/0073 312/196 |
| 7,584,705 | B2 * | 9/2009 | Chen | A47B 21/0073 108/50.01 |
| 8,069,598 | B2 * | 12/2011 | Garcia | G09F 7/18 353/69 |
| 8,205,563 | B2 * | 6/2012 | St. Louis | B64D 11/0638 108/42 |
| 8,276,857 | B2 * | 10/2012 | Cvek | F16M 11/2092 248/161 |
| 8,291,834 | B2 | 10/2012 | Romero Font | |
| 8,695,513 | B2 * | 4/2014 | Figueras Mitjans | A47B 19/08 108/115 |
| 8,915,196 | B2 * | 12/2014 | St. Louis | B64D 11/00 108/42 |
| 9,671,834 | B2 | 6/2017 | Holm Jensen et al. | |
| 10,137,990 | B2 * | 11/2018 | Lee | B61D 33/005 |
| 11,225,182 | B2 * | 1/2022 | Lee | B60N 3/102 |
| 2002/0101139 | A1 | 8/2002 | Lee | |
| 2004/0221775 | A1 | 11/2004 | Okninski | |
| 2007/0023557 | A1 | 2/2007 | Rankin, VI | |
| 2008/0060560 | A1 | 3/2008 | Chen | |
| 2018/0125228 | A1 * | 5/2018 | Porter | H05K 5/0017 |

OTHER PUBLICATIONS

"Technology serving design", Arthur Holm; 2020; pp. 1-2,16,18,27-28; https://www.arthurholm.com/wp-content/uploads/2020/12/AH_Book_20_e.pdf.

* cited by examiner

POP-UP DISPLAY

BACKGROUND OF THE INVENTION

Technical Field

The present embodiments relate to displays and touchscreens, and more particularly, to displays and touchscreens that can be hidden below a conference room table or other working surface and that can "pop-up" to a raised position above the table or the working surface.

Background Art

In many settings, it is desirable to provide a display, touchscreen, or other screen that extends above a table or other working surface when used but which can be hidden below the table or working surface when not in use. As an example, in a conference room or workspace setting, a display is desired that can extend above a conference room table or desk for use and lowered below that surface when not in use.

Typically, known devices for raising and lowering a display use electric motors to move the display up and down. Such devices typically require a power supply to drive the electric motor and require space under the table for the motor and other associated controls. Moreover, such electric motors are often prone to failure, leaving the display stuck above or beneath the surface.

It is therefore desirable to provide a device which can move a display up and down from a table or other surface using a simple mechanism.

SUMMARY OF THE INVENTION

It is to be understood that both the general and detailed descriptions that follow are exemplary and explanatory only and are not restrictive.

DISCLOSURE OF INVENTION

In accordance with an aspect, an apparatus drives and guides movement of a display assembly that includes a display unit. The apparatus includes: at least one track extending along at least one side of the display assembly and defining a path along which the display assembly is driven; a plurality of pins extending from the display assembly to the at least one track; and at least one constant force spring having at one end a coiled part that is rotatably coupled to the display assembly, and an opposing end fastened to a fixed mounting location, and an uncoiled part extending between the coiled part and the opposing end; the at least one constant force spring being configured to drive the display assembly from a lowered position to a raised position while the plurality of pins travels along the at least one track and guide movement of the display assembly.

According to a further aspect, an apparatus drives and guides movement of a display assembly that includes a display unit. The apparatus includes: a housing having a plurality of walls and a bottom; a pair of tracks disposed within the housing on opposing sides of the display assembly and defining a path along which the display assembly is driven; a respective pair of pins extending from each of the opposing sides of the display assembly to an adjacent one of the pair of tracks; and at least one constant force spring having at one end a coiled part that is rotatably coupled to the display assembly, and an opposing end fastened to a fixed mounting location, and an uncoiled part extending between the coiled part and the opposing end; the at least one constant force spring being configured to drive the display assembly from a lowered position, in which the display assembly is disposed entirely within the housing, to a raised position, in which the display assembly is partially disposed within the housing with the display unit being at least partially disposed outside the housing, while the respective pairs of pins travel along the pair of tracks and guide movement of the display assembly; each one of the pair of tracks including a straight part that guides the movement of the display assembly along a straight line from the lowered position, and a curved end part that guides further movement of display assembly to the raised position and that guides the display unit to a tilted position.

According to a still further aspect, an apparatus drives and guides movement of a display assembly that includes a display unit. The apparatus includes: a housing having a plurality of walls and a bottom; a pair of tracks disposed within the housing on opposing sides of the display assembly and defining a path along which the display assembly is driven; a respective pair of pins extending from each of the opposing sides of the display assembly to an adjacent one of the pair of tracks; a pair of constant force springs, each having at one end a respective coiled part that is rotatably coupled to the display assembly, a respective opposing end fastened to a respective fixed mounting location on the housing, and a respective uncoiled part extending between the coiled part and the opposing end; the pair of constant force springs being configured to drive the display assembly from a lowered position, in which the display assembly is disposed entirely within the housing, to a raised position, in which the display assembly is partially disposed within the housing with the display unit being at least partially disposed outside the housing, while the respective pairs of pins travel along the pair of tracks and guide movement of the display assembly; each one of the pair of tracks including a straight part that guides the movement of the display assembly along a straight line from the lowered position, and a curved end part that guides further movement of display assembly to the raised position and that guides the display unit to a tilted position; a catch part coupled to the display assembly; a hooking part coupled to the bottom of the housing and configured to releasably hold the catch part, wherein when the hooking part holds the catch part, the display assembly is held in the lowered position, and upon the hooking part releasing the catch part, the display assembly is driven from the lowered position by the at least one constant force spring; a driving mechanism configured to move the hooking part between a holding position in which the hooking part holds the catch part and a released position in which the hooking part does not hold the catch part; a release switch configured to control power to the driving mechanism such that the hooking part is moved from the holding position to the released position; a pair of slide rails coupled to one of the plurality of walls of the housing; a slider affixed to the display assembly; the slider being disposed between, and contacting, the pair of slide rails such that while the display assembly is moved from the lowered position to the raised position, the pair of slide rails slow the movement of the slider, thereby slowing the movement of the display assembly; a gear rotatably coupled to the display assembly, and a gear rack coupled to the one of the plurality of walls of the housing, the gear rack being mated with the gear such that while the display assembly is moved from the lowered position to the raised position, the gear moves along the gear rack and slows the movement of the display assembly.

BRIEF DESCRIPTION OF DRAWINGS

The accompanying figures further illustrate the present embodiments.

The components in the drawings are not necessarily drawn to scale, emphasis instead being placed upon clearly illustrating the principles of the present embodiments. In the drawings, like reference numerals designate corresponding parts throughout the several views.

BRIEF DESCRIPTION OF THE SEVERAL VIEWS OF THE DRAWINGS

Figure 1:
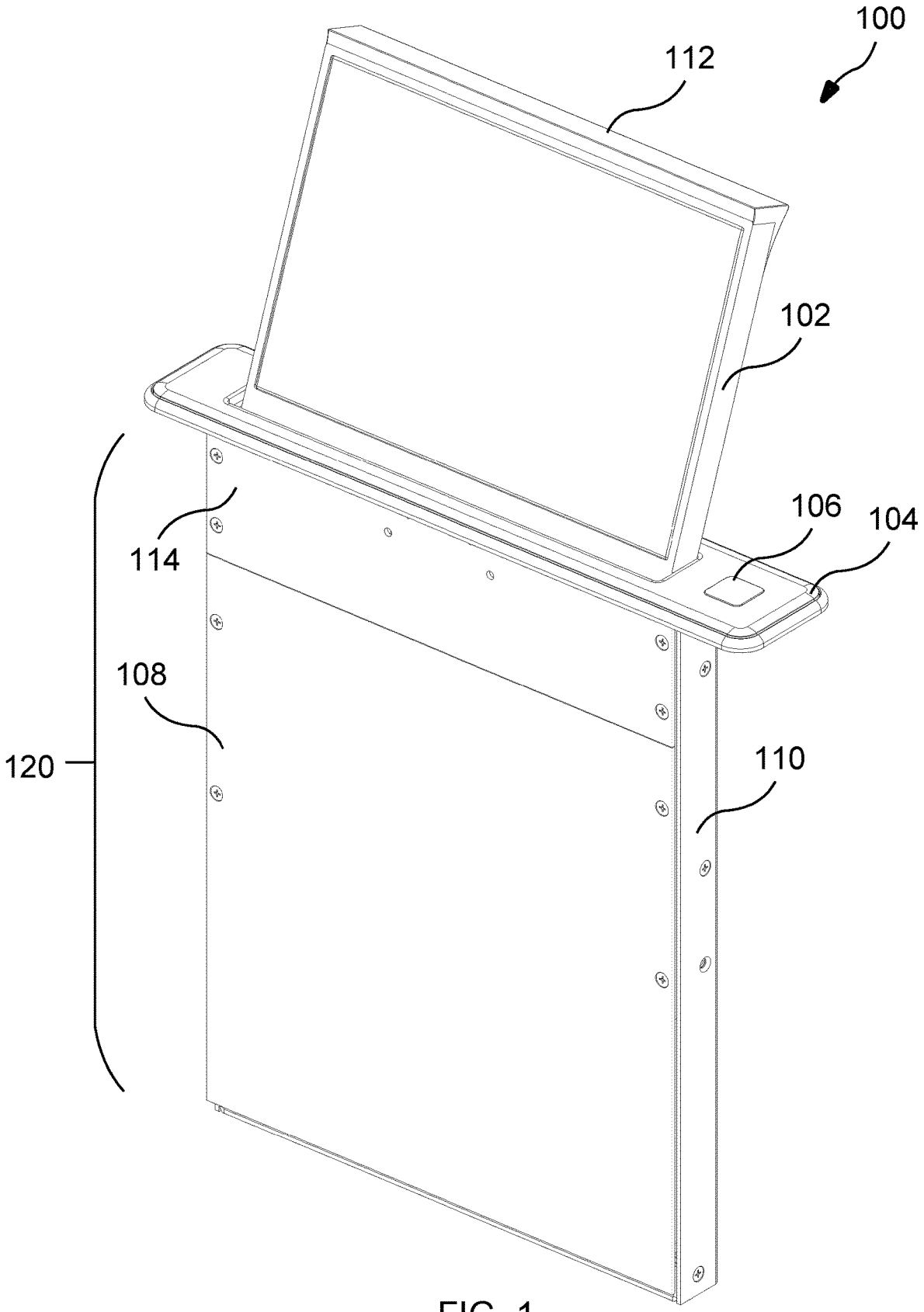

FIG. 1 is a perspective view of a pop-up display device showing the display in a raised, tilted position in accordance with an embodiment.

FIGS. 2A-2D are perspective views of the pop-up display device of FIG. 1 showing the display lowered, partially raised, near fully raised, and fully raised and tilted, respectively.

FIGS. 3A-3D are side views of the pop-up display device of FIG. 1 with a side cover removed and showing the display lowered, near fully raised, fully raised and partially tilted, and fully raised and fully tilted, respectively.

Figure 4A:
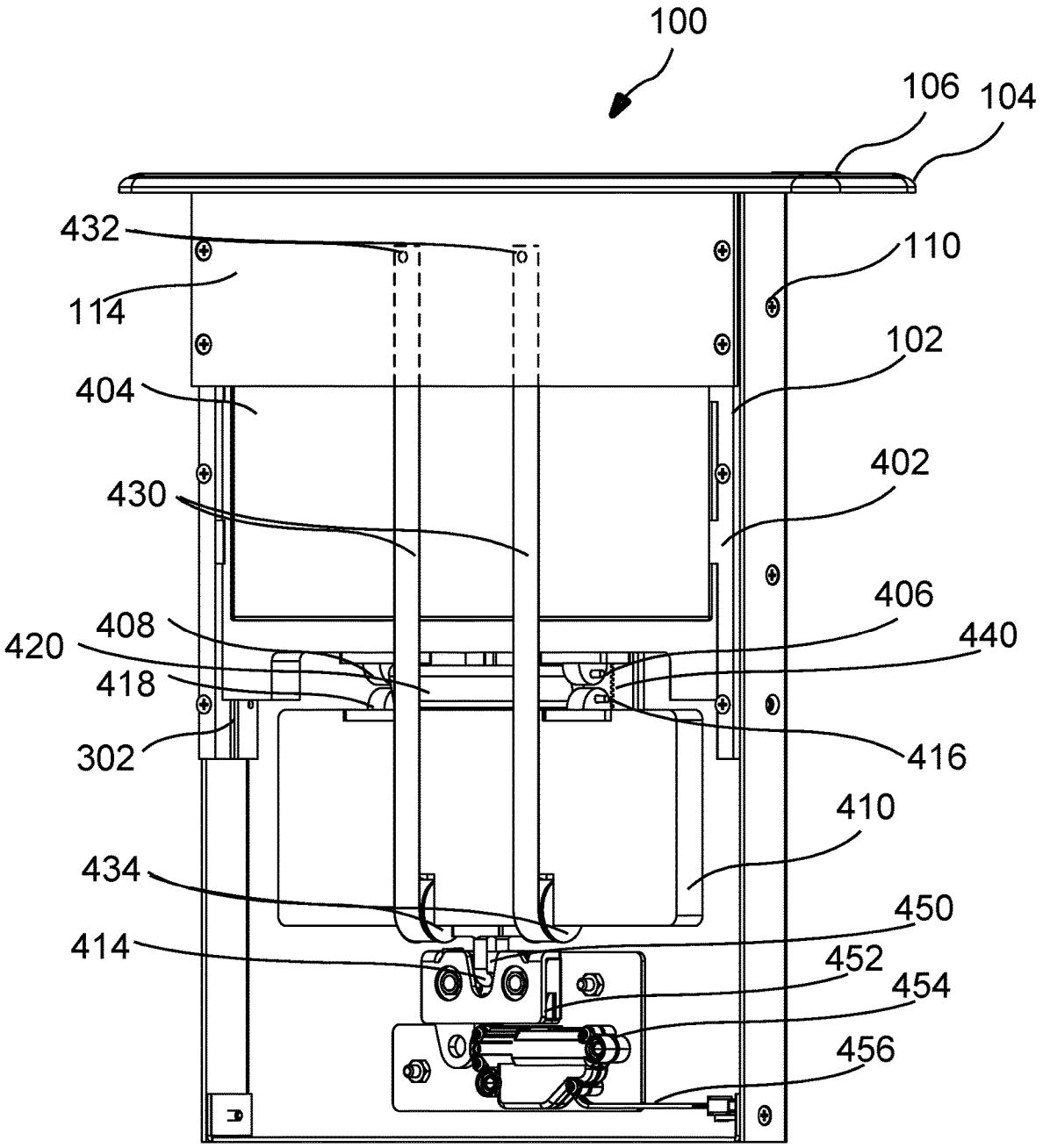
Figure 4B:
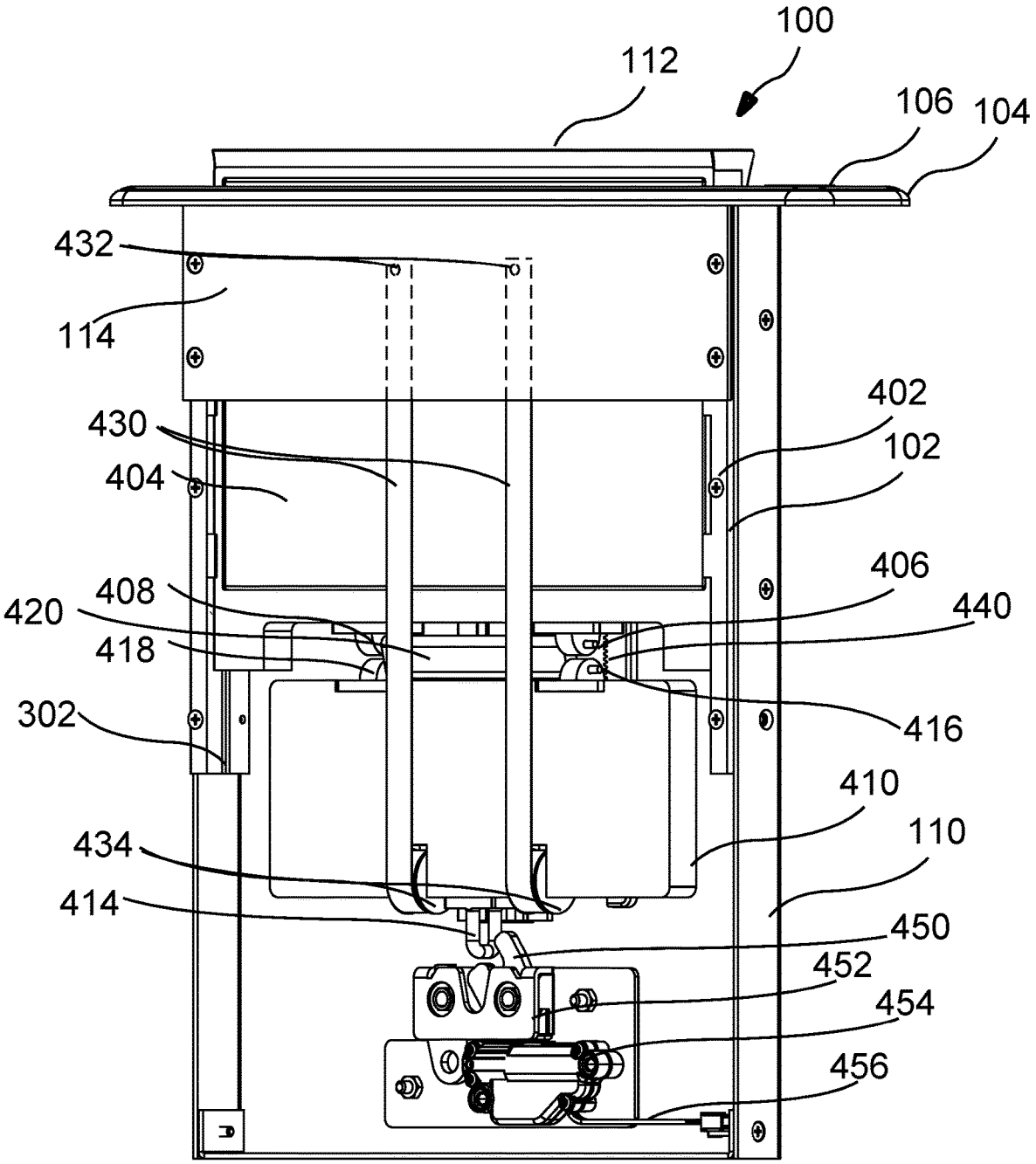
Figure 4C:
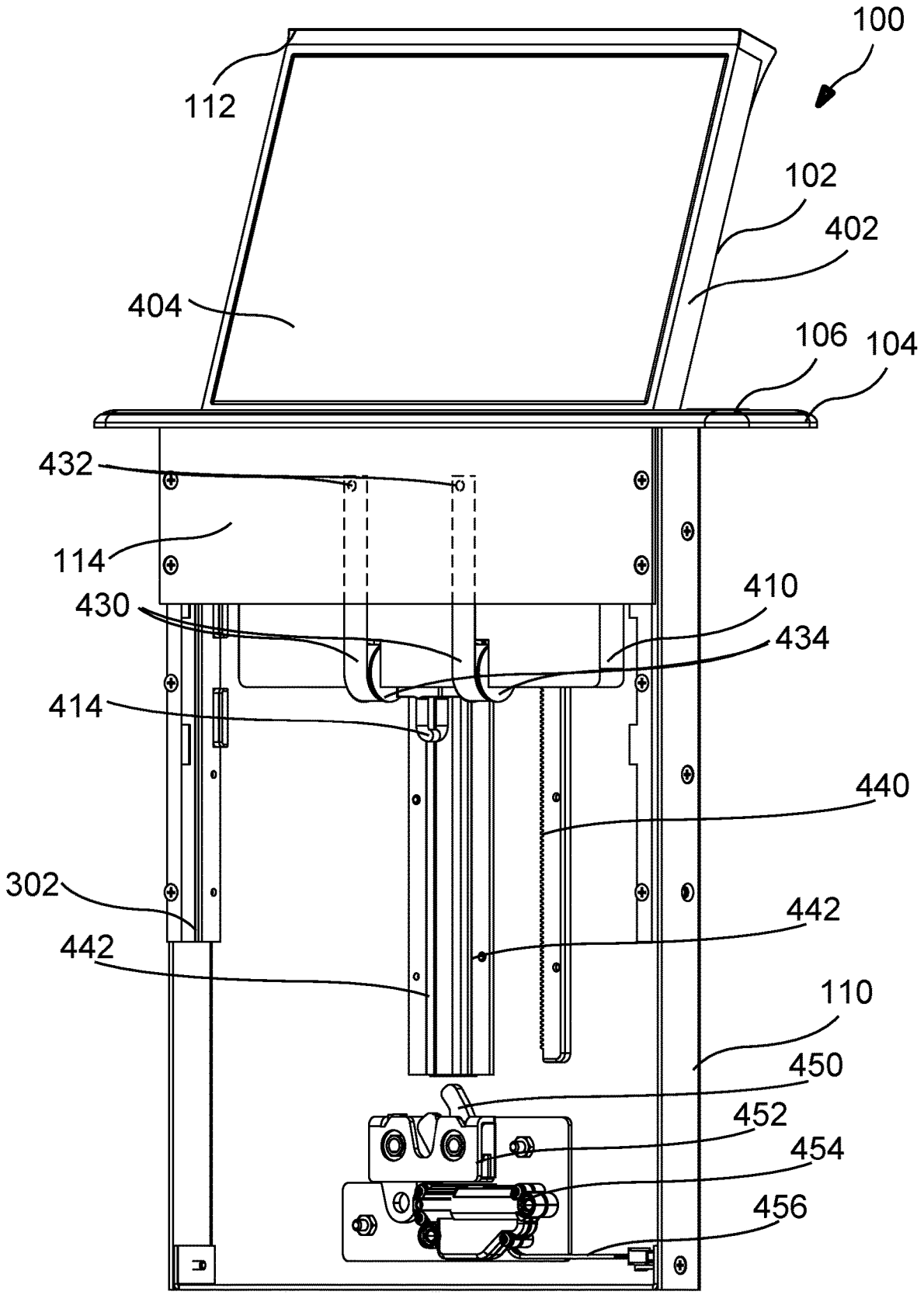

FIGS. 4A-4C are front perspective views of the pop-up display device of FIG. 1 with a front cover removed and showing the display lowered, partly raised, and fully raised and tilted, respectively.

Figure 5:
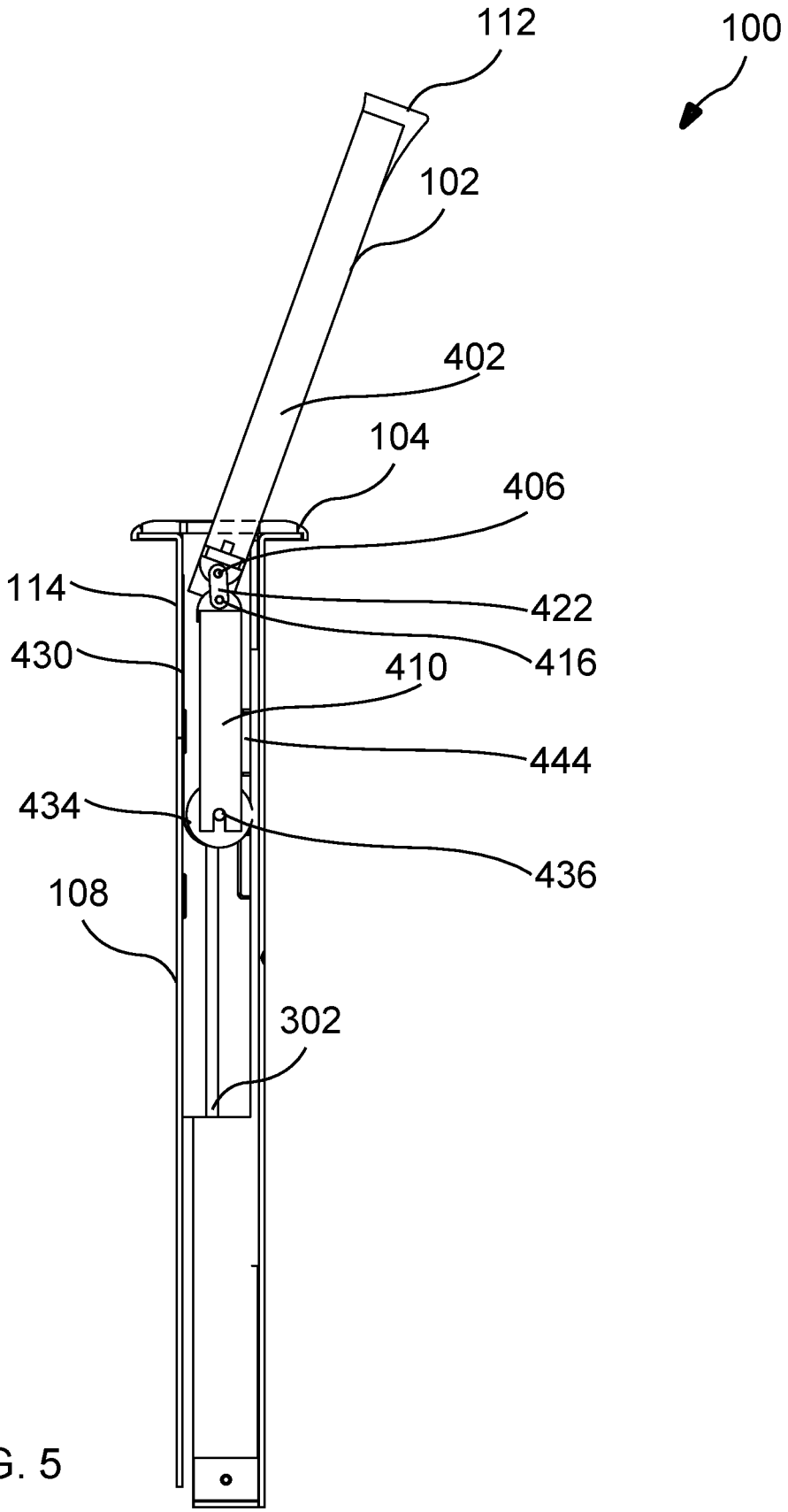

FIG. 5 is a side view of the pop-up display device of FIG. 1 with a side cover and side track removed and showing the display in fully raised and fully tilted position.

Figure 6A:
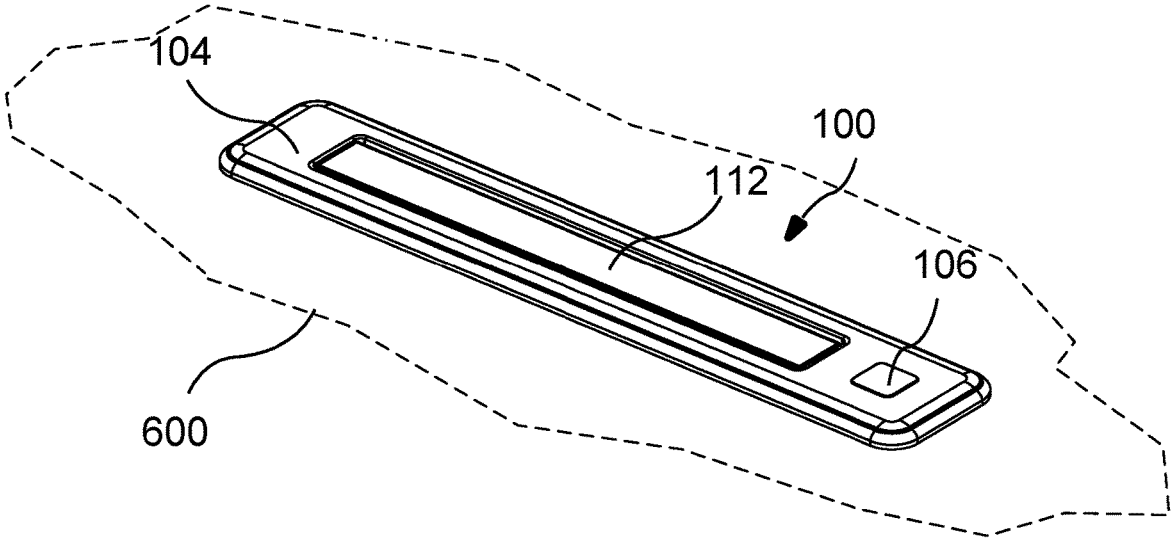
Figure 6B:
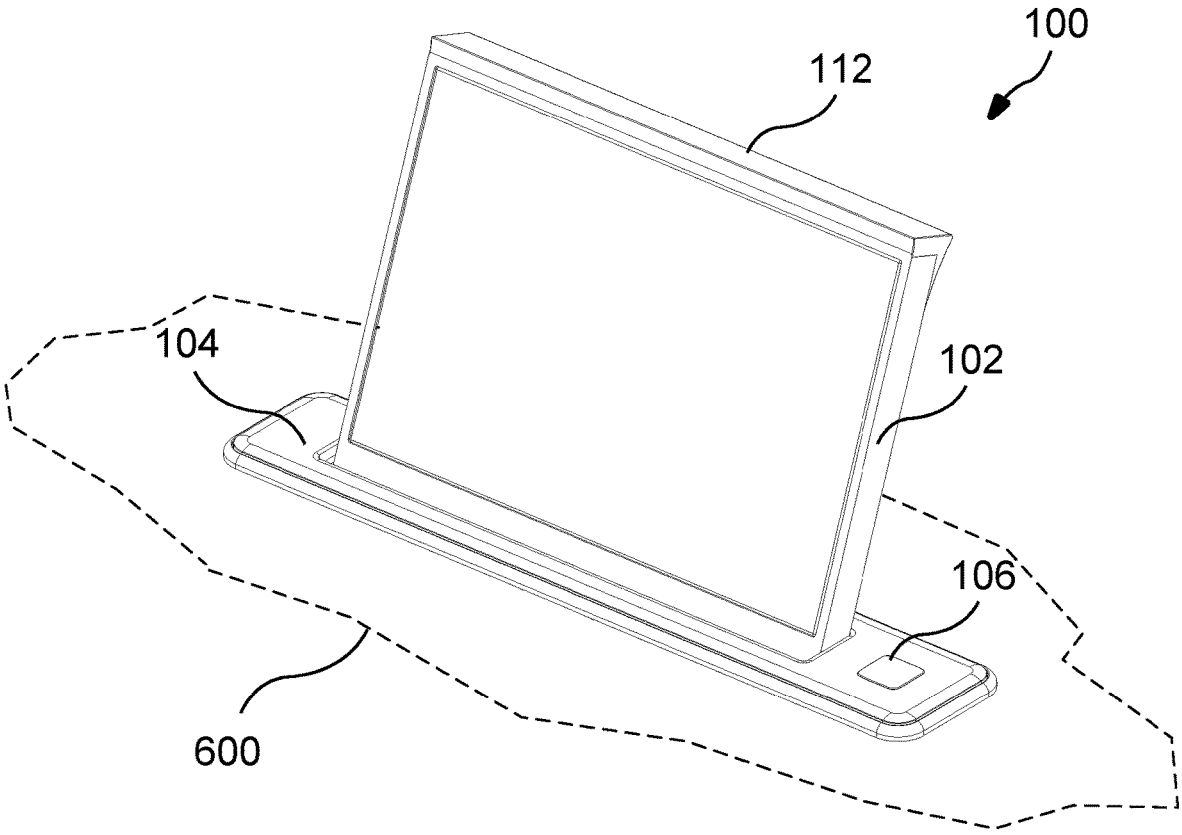

FIGS. 6A and 6B are perspective views of the pop-up display device of FIG. 1 mounted in an opening in a working surface and showing the display unit in the fully lowered position and in the fully raised, fully tilted position, respectively.

DETAILED DESCRIPTION OF THE INVENTION

The present embodiments provide a pop-up display that can be set in an opening in a table or other working surface, and which can be stored below or raised above the table or working surface.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

LIST OF REFERENCE NUMBERS FOR THE MAJOR ELEMENTS IN THE DRAWINGS

The following is a list of the major elements in the drawings in numerical order.

100 Pop-Up Display Device
102 Display Unit
104 Housing Top Panel
106 Release Switch
108 Housing Front Panel
110 Housing Side Panel
112 Display Top Cover
114 Housing Front Panel
120 Housing
300 Inner Side Panel
302 Side Track
303 Curved Upper Portion
304 Upper Pin
306 Lower Pin
402 Display Frame
404 Display Screen
406 Pin
408 Curved Part
410 Electronics Housing
414 Staple Catch
416 Pin
418 Curved Part
420 Connecting Piece
430 Constant Force Springs
432 Spring Mount Locations
434 Drum
436 Drum Pivot
440 Gear rack
442 Slide Rails
444 Slider
450 Movable Latch Hook
452 Latch Mechanism
454 Power Supply
456 Power Line
600 Working Surface

MODE(S) FOR CARRYING OUT THE INVENTION

The embodiment described herein in the context of displays and working surfaces, but is not limited thereto, except as may be set forth expressly in the appended claims.

Referring first to FIG. 1, a pop-up display device 100 is shown. The pop-up display device 100 includes a display unit 102 and a housing 120 that includes an upper front panel 108, a lower front panel 114, and side panels 110. A housing top panel 104 is configured to rest atop a table or other working surface such that the rest of the housing 120 is concealed below the table or working surface. A release switch 106 is located in the top panel 104 and controls the release of the display unit 120. A display top cover 112 is located atop the display housing 102.

FIGS. 2A-2D show the pop-up display device 100 with the display unit 102 in various positions.

Figure 2A:
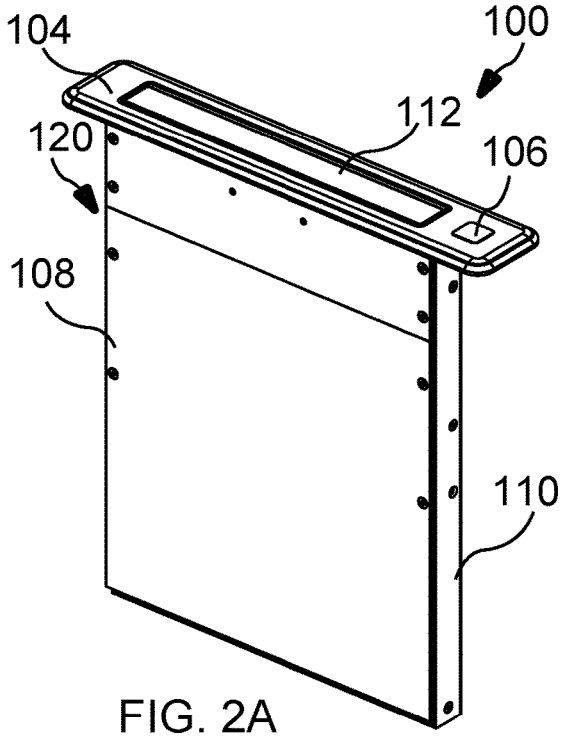

FIG. 2A shows the pop-up display device 100 with the display unit 102 hidden inside the housing 120 and, typically, disposed below a table surface or other working surface. Only the display top cover 112 and the housing top panel 104 are visible.

Figure 2B:
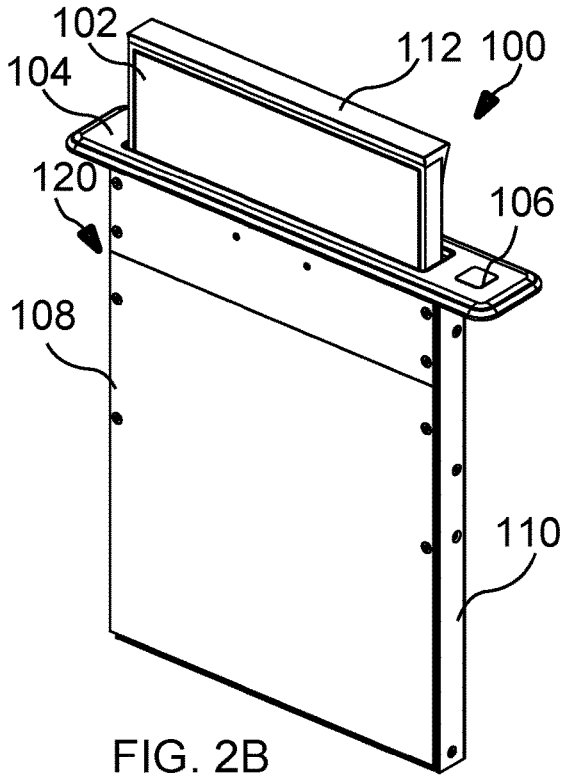
Figure 2C:
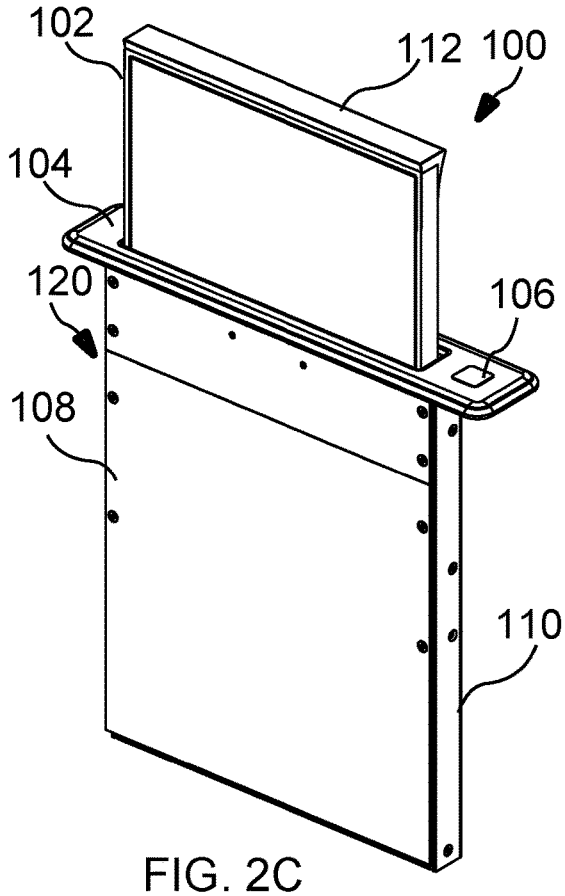
Figure 2D:
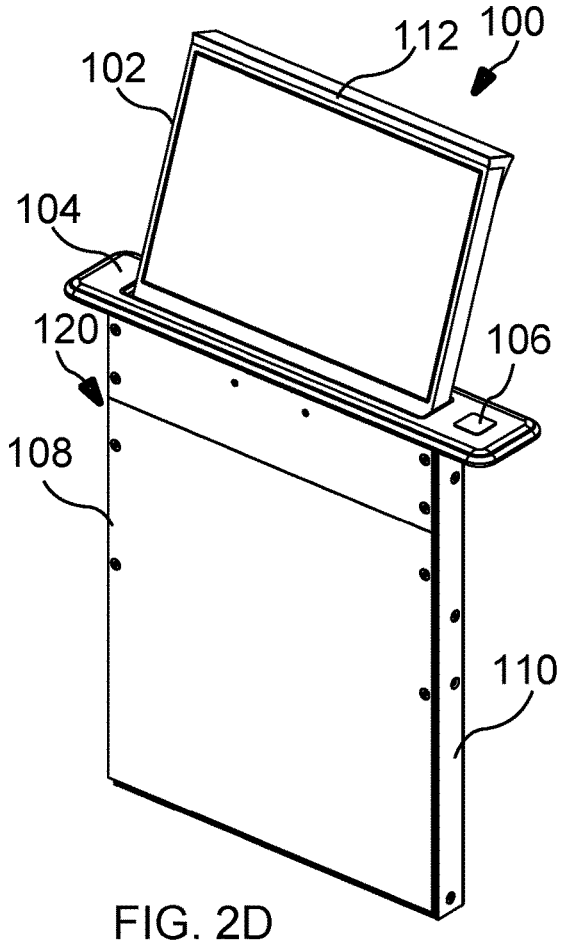

FIG. 2B shows the pop-up display device 100 with the display unit 102 partially raised. FIG. 2C shows the pop-up display device 100 with the display unit 102 now fully raised but not tilted. FIG. 2D shows the pop-up display device 100 with the display unit 102 both fully raised and fully tilted. Typically, the display is fully tilted when tilted at an angle of about 20° from its initial fully raised orientation.

FIGS. 3A-3D show how the display unit 102 is guided as it travels from the fully lowered position shown in FIG. 2A to the fully raised and fully tilted position shown in FIG. 2D. A side view of the pop-up display device 100 is shown with the side panel 110 of the housing 120 removed. An inner side panel 300 includes a side track 302 along which an upper pin 304 and a lower pin 306 traverse. The upper pin 304 and lower pin 306 are each coupled to the display unit 102 and guide the movement of the display unit 102 as it travels up or down.

Figure 3A:
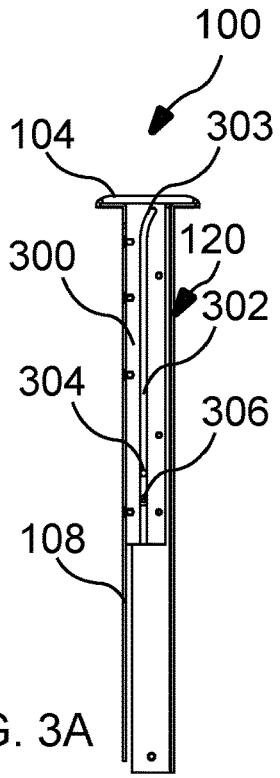

FIG. 3A shows the pop-up display device 100 with the display unit 102 in its fully lowered position corresponding to the position shown in FIG. 2A. The upper pin 304 and lower pin 306 are accordingly in their lowest positions along a straight portion of the track 302.

Figure 3B:
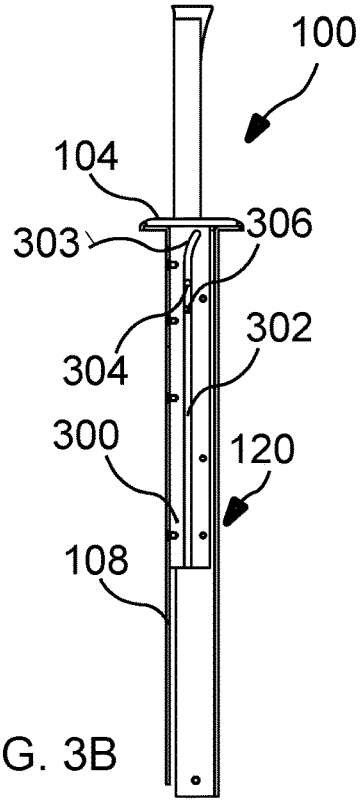

FIG. 3B shows the pop-up display device 100 with the display unit 102 fully raised but not tilted, corresponding to the position shown in FIG. 2C. The upper pin 304 and lower pin 306 are accordingly in higher positions along the straight portion of the track 302.

Figure 3C:
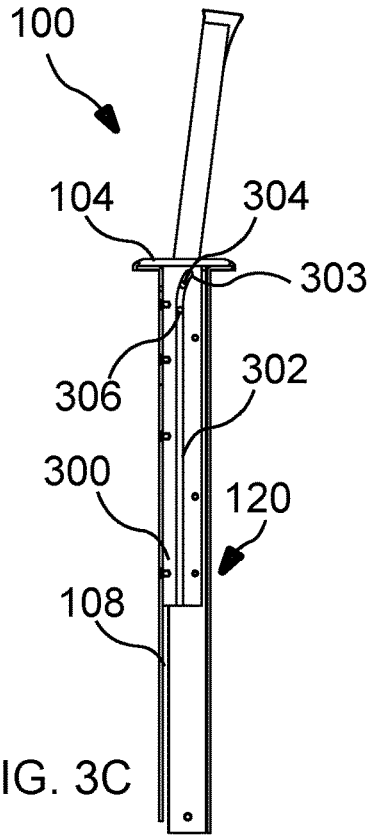

FIG. 3C shows the pop-up display device 100 with the display unit 102 now partially tilted. The upper pin 304 now travels the curved upper portion 303 of the track 302 while the lower pin 306 continues to travel along the straight portion of the track 302. The movement of the upper pin 304 along the curved portion of the track 302 directs the display unit 102 to tilt as shown.

Figure 3D:
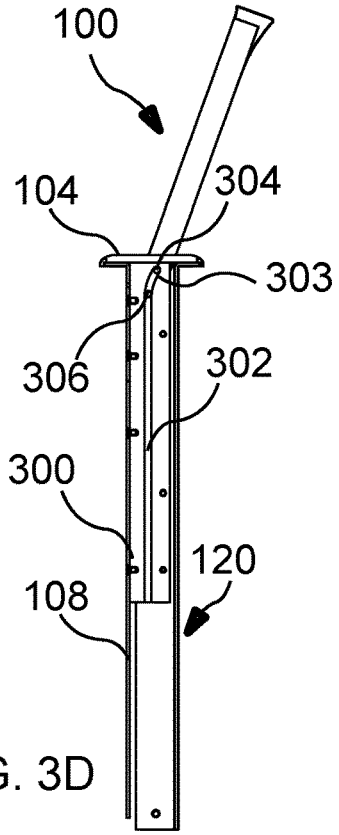

FIG. 3D shows the pop-up display device 100 with the display unit 102 in its fully tilted position, corresponding to the position shown in FIG. 2D. The upper pin 304 has traveled to the end of the curved upper portion 303 of the track 302, which prevents further upward movement of the upper pin 304 as well as prevents further upward movement the lower pin 306. The display unit 102 therefore remains fully tilted at a predefined angle, typically at about 20° from the vertical.

FIGS. 3A-3D show the inner side panel 300, the side track 302, the upper pin 304, and the lower pin 306 of only one side of the housing 120. A corresponding inner side panel, side track, upper pin, and lower pin are provided on the opposing side of the housing 120, and similarly guide the display unit 102 as it moves between the fully lowered position and the fully raised, fully tilted position.

FIGS. 4A-4C are front perspective views of the pop-up display device 100 showing the housing 120 with the lower front panel 108 removed.

FIG. 4A shows the pop-up display device 100 with the display unit 102 in its fully lowered position and corresponds to the position shown in FIGS. 2A and 3A. The display unit 102 includes a display screen 404 and a display frame 402, from which the pins 304, 306, shown in FIGS. 3A-3D, extend. A pair of curved parts 408 are disposed at the bottom of the display frame 402, and a pair of pins 406 extend respectively through the curved parts 408. Each of the pins 406 also extends into an upper part of a connecting piece 420 so that the display unit 102 is rotatably coupled to the connecting piece 420 about the pins 406. Alternatively, a single pin 406 extends through both curved parts 408 as well as through the connecting piece 420 to provide the rotatable coupling about the single pin.

An electronics housing 410 is located below the display unit 102 and comprises a display assembly together with the display unit 102. A pair of curved parts 418 are disposed at the top of the display frame 402, and a pair of pins 416 extend respectively through the curved parts 418. Each of the pins 416 also extends into a lower part of the connecting piece 420 so that the electronics housing 410 is rotatably coupled to the connecting piece 420 about the pins 416. Alternatively, a single pin 416 extends through both curved parts 418 as well as through the connecting piece 420 to provide the rotatable coupling about the single pin.

The rotatable coupling between the display unit 102 and the connecting piece 420 and the rotatable coupling between the connecting piece 420 and the electronics housing 410 combine to allow the display unit 102 to have a sufficient degree of free movement such that it can travel from the fully vertical orientation to the fully tilted orientation.

A pair of constant force springs 430 provides an upward force on the electronics housing 410 and the display unit 102. The constant force springs 430 are each coiled at one end around a corresponding one of a pair of drums 434. Each one of the pair of drums 434 is rotatably coupled to a lower part of the electronics housing 410 about a corresponding one of a pair of pins 436 (shown in FIG. 5). An opposing end of each constant force spring 430 is affixed to an inner surface of the upper front panel 114 at a spring mounting location 432. An uncoiled portion of each constant force spring 430 extends between coiled end at the drum 434 and he mounted end at the mounting location 432.

A staple catch 414 extends from a bottom of the electronics housing 410. A latch hook 450 is movable between an engaged position where it hooks the staple catch 414, as shown in FIG. 4A, and a released position, shown in FIGS. 4B and 4C. A latch mechanism 452 a power supply 454 combine to hold the latch hook 450 in either the engaged position or the released position. A power line 456 supplies power to power supply 454 under the operation of the release switch 106 disposed in the housing top panel 104. Typically, operation of the release switch 106 causes the latch mechanism 452 to move from the engaged position to the released position. For example, when the release switch 106 includes a push-button, release of the latch hook 450 may be carried out by depressing the push-button.

FIG. 4B shows the pop-up display device 100 shortly after operation of the release switch 106. The operation of the release switch 106 turns off or otherwise changes the power supplied to the power supply 454 in a manner that causes the latch hook 450 to move away from the staple catch 414, thereby releasing the staple catch 414 and allowing the display unit 102 and the electronics housing 410 to move. The force exerted by the constant force springs 430 then drives the display unit 102 and the electronics housing 410 upward and away from the fully lowered position shown in FIG. 4A. As shown in FIG. 4B, the staple catch 414 has separated from the latch hook 450 and, concurrently, the display unit 102 has begun to travel upward while the display top cover 112 begins to move away from the housing top panel 104.

As the display unit 102 and the electronics housing 410 continue to travel upward, the pins 304, 306, shown in FIGS. 3A-3D, traverse along the side tracks 302 located on each side of the housing 120. At least one slider 444 (shown in FIG. 5) is attached to the electronics housing 410 and slides upward between the slide rails 442 which serve to further guide the movement of the display unit 102. Additionally, frictional engagement between the slider 444 and the slide rails 442 act a damper on the movement of the display unit 102 and the electronics housing 410 to slow down the upward movement. Also, at least one gear (not shown), such as a helical gear or other gear, is rotatably coupled to the electronics housing 410 and engages with a gear rack 440, shown in FIG. 4C, and rotates as the display unit 102 and the electronics housing 410 move upward. The engagement between the gear and the gear rack 440 also acts as a damper and further slows the upward movement.

FIG. 4C also shows the display unit 102 and the electronics housing 410 in the fully raised position with the display unit 102 fully tilted, as also shown in FIGS. 1, 2D and 3D.

FIG. 5 shows a side view of the pop-up display device 100 with both the side panel 110 and the inner side panel 300 of the housing 120 removed. FIG. 5 also shows the pop-up display device 100 with the display unit 102 and the electronics housing 410 in the fully raised position and the display unit 102 fully tilted. When the display unit 102 is in the fully raised position, the constant force spring 430 is almost entirely wound around the drum 434 except for a portion disposed between the drum 434 and the mount location 432.

FIG. 6A shows the pop-up display device 100 mounted in an opening in a table top surface or other working surface 600, shown as a cutaway portion, with the display unit 102 in the fully lowered position. Only the display top cover 112 and the housing top panel 104 are visible. The remainder of the housing 120 is disposed below the working surface 600 and is hidden.

To raise the display unit 102 from its fully lowered position, a user merely depresses or otherwise activates the release switch 106, causing the latch hook 450 to move and release the staple catch 414 so that the force always exerted by the constant force spring 430 on the electronics housing 410 can now drive the display unit 102 and the electronics housing 410 to travel upward. Because the constant force springs 430 are used, the display unit 102 travels upward at a constant speed. The slider 444, which is attached to the display unit 102, concurrently moves between the slide rails 442 to guide the upward movement of the display unit 102 while the friction between the slider 444 and the slide rails 442 dampens the force exerted by the constant force spring 430 to slow down this movement. Further, the gear (not shown) also travels with the display unit 102, and the interaction between the gear and the gear rack 440 also guides the upward movement of the display unit 102 while dampening the force exerted by the constant force spring 430 to slow down this upward movement. The upward movement of the display unit 102 is further guided by the movement of the pins 304, 306 along the side track 302 with the curved portion of 303 at the upper end of the side track 302 guiding pins 304, 306 to cause the display unit 102 to tilt.

FIG. 6B shows the mounted pop-up display device 100 with the display unit 102 in the fully raised position. Only the display unit 102 and the housing top panel 104 are visible.

Conversely, to lower the display unit 102 from its fully raised, fully tilted position to its fully lowered position, the user merely presses down on the display top cover 112 until the staple catch 414 is engaged by and held by the latch hook 450.

In this manner, the display unit 102 of the pop-up display device 100 can be raised and lowered by simple operations.

INDUSTRIAL APPLICABILITY

To solve the aforementioned problems, the present embodiments provide a pop-up display that utilizes constant force springs and dampers to raise a touch panel display to above a surface.

ALTERNATE EMBODIMENTS

Alternate embodiments may be devised without departing from the spirit or the scope of the embodiments.

What is claimed is:

1. An apparatus for driving and guiding movement of a display assembly, the apparatus comprising:

a first track extending along, and disposed adjacent to, a first side of the display assembly and defining a path along which the display assembly is driven;

a first pair of pins each extending from the first side of the display assembly into the first track; and at least one constant force spring having at one end a coiled part that is rotatably couple to the display assembly, an opposing end fastened to a fixed mounting location, and an uncoiled part extending between the coiled part and the opposing end;

the at least one constant force spring being configured to drive the display assembly from a lowered position to a raised position while the first pair of pins travels along the first track which guides movement of the display assembly, wherein the first track includes a straight part that guides the movement of the first pair of pins along a straight line while the at least one constant force spring drives the display assembly from the lowered position, and a curved end part that guides further movement of the first pair of pins while the at least one constant force spring subsequently drives the display assembly to the raised position and into a tilted orientation.

2. The apparatus of claim 1, wherein the display assembly includes a display unit, the first pair of pins each extending from the display unit into the first track, and an electronics housing separate from the display unit and pivotally coupled at one end to an adjacent end of the display unit, the coiled part of the at least one constant force spring being rotatably coupled to another end of the electronics housing, such that the display unit and the electronics housing each move in a straight line while the first pair of pins are guided along the straight part of the first track, and the display unit pivots about the electronics housing while the first pair of pins are guided along the curved part of the first track so that the display unit is guided to the tilted orientation.

3. An apparatus for driving and guiding movement of a display assembly, the apparatus comprising:

a first track extending along, and disposes adjacent to, a first side of the display assembly and defining a path along which the display assembly is driven;

a first pair of pins each extending from the first side of the display assembly into the first track; and at least one constant force spring having at one end a coiled part that is rotatably coupled to the display assembly, an opposing end fastened to a fixed mounting location, and an uncoiled part extending between the coiled part and the opposing end;

the at least one constant force spring being configured to drive the display assembly from a lowered position to a raised position while the first pair of pins travels along the first track which guides movement of the display assembly, wherein the display assembly includes a display unit, and an electronics housing separate from the display unit and pivotally coupled at one end to an adjacent end of the display unit such that the display unit and the electronics housing move in tandem as the display assembly moves between the lowered position and the raised position.

4. An apparatus for driving and guiding movement of a display assembly, the apparatus comprising:

a housing having a plurality of walls and a bottom;

a first track disposed within the housing adjacent to one side of the display assembly;

a second track disposed within the housing adjacent to an opposing side of the display assembly, the first and second tracks defining a path along which the display assembly is driven;

a first pair of pins extending from one side of the display assembly into the first track;

a second pair of pins extending from an opposing side of the display assembly into the second track; and at least one constant force spring having at one end a coiled part that is rotatably coupled to the display assembly, and an opposing end fastened to a fixed mounting location on the housing, and an uncoiled part extending between the coiled part and the opposing end;

the display assembly including a display unit, and an electronics housing separate from the display unit and pivotally coupled at one end to an adjacent end of the display unit, the coiled part of the at least one constant force spring being rotatably coupled to another end of the electronics housing;

the at least one constant force spring being configured to drive the display assembly from a lowered position, in which the display unit and the electronics housing are each disposed entirely within the housing, to a raised position, in which the electronics housing is disposed within the housing and the display unit is at least partially disposed outside the housing, while the first and second pairs of pins travel along the first and second tracks, respectively, which guides movement of the display assembly;

the first and second tracks each including a straight part that guides the movement of the display unit and the electronics housing along a straight line from the lowered position, and a curved end part that guides further movement of the display unit and the electronics housing to the raised position and into a tilted orientation.

5. The apparatus of claim 4, wherein the at least one constant force spring includes a pair of constant force springs, each having at one end a respective coiled part that is rotatably coupled to the display assembly, a respective opposing end fastened to a respective fixed mounting location on the housing, and a respective uncoiled part extending between the coiled part and the opposing end.

6. The apparatus of claim 4, further comprising a catch part coupled to the display assembly; and a movable hooking part coupled to the bottom of the housing and configured to releasably hold the catch part;

wherein when the display assembly is driven manually to the lowered position, the hooking part catches the catch part and holds the display assembly in the lowered position.

7. The apparatus of claim 6, further comprising an electrically powered driving mechanism configured to move the hooking part from a holding position in which the hooking part holds the catch part to a released position in which the hooking part releases the catch part and permits the at least one constant force spring to drive the display assembly from the lowered position, and a power supply configured to supply electrical power to the driving mechanism.

8. The apparatus of claim 7, further comprising an electronic release switch configured to control the electrical power supplied to the driving mechanism in a manner that moves the hooking part from the holding position to the released position.

9. The apparatus of claim 4, further comprising a pair of slide rails coupled to one of the plurality of walls of the housing, and a slider affixed to the display assembly, the slider being disposed between, and contacting, the pair of slide rails such that while the display assembly is moved from the lowered position to the raised position, the pair of slide rails slow the movement of the slider, thereby slowing the movement of the display assembly.

10. The apparatus of claim 4, further comprising a gear rotatably coupled to the display assembly, and a gear rack coupled to one of the plurality of walls of the housing, the gear rack being mated with the gear such that while the display assembly is moved from the lowered position to the raised position, the gear moves along the gear rack and slows the movement of the display assembly.

11. The apparatus of claim 4, wherein the fixed mounting location is located on an inner side of one of the plurality of walls of the housing.

12. An apparatus for driving and guiding movement of a display assembly, the apparatus comprising:

a housing having a plurality of walls and a bottom;

a first track disposed within the housing adjacent to one side of the display assembly;

a second track disposed within the housing adjacent to an opposing side of the display assembly, the first and second tracks together defining a path along which the display assembly is driven;

a first pair of pins extending from one side of the display assembly into the first track;

a second pair of pins extending from an opposing side of the display assembly into the second track;

a pair of constant force springs, each having at one end a respective coiled part that is rotatably coupled to the display assembly, a respective opposing end fastened to a respective fixed mounting location on the housing, and a respective uncoiled part extending between the coiled part and the opposing end;

the display assembly including a display unit, and an electronics housing separate from the display unit and pivotally coupled at one end to an adjacent end of the display unit such that the display unit and the electronics housing move in tandem as the display assembly moves between the lowered position and the raised position, the coiled part of the at least one constant force spring being rotatably coupled to another end of the electronics housing;

the pair of constant force springs being configured to drive the display assembly from a lowered position, in which the display unit and the electronics housing are disposed entirely within the housing, to a raised position, in which the electronics housing is disposed within the housing and the display unit is at least partially disposed outside the housing, while the first and second pairs of pins travel along the pair of tracks which guides movement of the display assembly;

each one of the first and second tracks including a straight part that guides the movement of the electronics housing and the display unit along a straight line from the lowered position while the first pair of pins moves along the straight part of the first track and the second pair of pins moves along the straight part of the second track, and a curved end part that guides further movement of the electronics housing and the display unit to the raised position and that guides the display unit to pivot about the electronics housing into a tilted orientation while the first pair of pins moves along the curved part of the first track and the second pair of pins moves along the curved part of the second track;

a catch part coupled to the display assembly;

a movable hooking part coupled to the bottom of the housing and configured to releasably hold the catch part, wherein when the display assembly is driven manually to the lowered position, the hooking part catches the catch part and holds the display assembly in the lowered position;

a driving mechanism configured to move the hooking part from a holding position in which the hooking part holds the catch part to a released position in which the hooking part releases hold the catch part and permits the at least one constant force spring to drive the display assembly from the lowered position;

a power supply configured to supply electrical power to the driving mechanism to control whether the hooking part is in the holding position or in the released position;

an electronic release switch configured to control the electrical power supplied to the power supply and thereby to the driving mechanism such that the hooking part is moved from the holding position to the released position;

a pair of slide rails coupled to one of the plurality of walls of the housing;

a slider affixed to the display assembly;

the slider being disposed between, and contacting, the pair of slide rails such that while the display assembly is moved from the lowered position to the raised position, the pair of slide rails slow the movement of the slider, thereby slowing the movement of the display assembly;

a gear rotatably coupled to the display assembly, and a gear rack coupled to the one of the plurality of walls of the housing, the gear rack being mated with the gear such that while the display assembly is moved from the lowered position to the raised position, the gear moves along the gear rack and slows the movement of the display assembly.

13. The apparatus of claim 12, wherein the respective fixed mounting location is located on an inner side of a respective one of the plurality of walls of the housing.

* * * * *